US007532545B2

(12) United States Patent
Boileau

(10) Patent No.: US 7,532,545 B2
(45) Date of Patent: May 12, 2009

(54) TIME PIECE PROVIDED WITH A DATE DIAL

(76) Inventor: Sylvain Boileau, 17 Hameau Lou Margali, F-74140 Excenevex (FR)

( * ) Notice: Subject to any disclaimer, the term of this patent is extended or adjusted under 35 U.S.C. 154(b) by 0 days.

(21) Appl. No.: 12/094,341

(22) PCT Filed: Nov. 20, 2006

(86) PCT No.: PCT/IB2006/003327

§ 371 (c)(1),
(2), (4) Date: Aug. 25, 2008

(87) PCT Pub. No.: WO2007/057776

PCT Pub. Date: May 24, 2007

(65) Prior Publication Data

US 2008/0316869 A1 Dec. 25, 2008

(30) Foreign Application Priority Data

Nov. 21, 2005 (FR) ..... 05 11830

(51) Int. Cl.
*G04B 19/20* (2006.01)
*G04B 19/24* (2006.01)

(52) U.S. Cl. ..... 368/28; 358/37

(58) Field of Classification Search ..... 368/28, 368/35–38

See application file for complete search history.

(56) References Cited

U.S. PATENT DOCUMENTS 5,432,759 A * 7/1995 Vaucher ..... 368/28
6,081,483 A * 6/2000 Capt et al. ..... 368/28
6,574,167 B2 * 6/2003 Weissbach et al. ..... 368/35

(Continued)

FOREIGN PATENT DOCUMENTS

CH 690 869 A5 2/2001

(Continued)

OTHER PUBLICATIONS

Notification of Transmittal of Copies of Translation of the International Preliminary Report on Patentability (Form PCT/IB/338) of International Application No. PCT/IB2006/003327 mailed Nov. 20, 2006 with Forms PCT/IB/373 and PCT/ISA/237.

(Continued)

*Primary Examiner*—Vit W Miska
(74) *Attorney, Agent, or Firm*—Westerman, Hattori, Daniels & Adrian, LLP.

(57) ABSTRACT

The inventive timepiece provided with a date dial comprises a date disc driven step by step once per 24 hours. The dial of the time piece is provided with unit figures distributed along a circular sector and crossed by a window which is embodied in the form of a circular arc and extends through the entire angular length of the circular sector. A display member connected to the date disc appears in the window and comprises an index of units, figures 1 and 2 of tens and a window for figure 3 of tens. A screen associated to a return spring is positioned between the dial and the display member provided with an element for driving the movable screen oppositely to the return spring in order to position it in front of the index when said index is situated in front of the figure 0 of units.

3 Claims, 5 Drawing Sheets

U.S. PATENT DOCUMENTS

| | | | | |
|---|---|---|---|---|
| 6,738,316 | B2 * | 5/2004 | Gabathuler et al. | 368/28 |
| 7,110,326 | B2 * | 9/2006 | Besse | 368/37 |
| 2003/0193840 | A1 * | 10/2003 | Huter | 368/37 |
| 2005/0174891 | A1 | 8/2005 | Besse | |

FOREIGN PATENT DOCUMENTS

| | | | |
|---|---|---|---|
| DE | 41 27 825 | C1 | 10/1992 |
| EP | 1 070 996 | A1 | 1/2001 |
| EP | 1 369 753 | A1 | 12/2003 |
| EP | 1 426 836 | A2 | 6/2004 |
| FR | 1 497 981 | A | 10/1967 |

OTHER PUBLICATIONS

International Search Report of PCT/IB2006/003327, date of mailing Aug. 21, 2007.

* cited by examiner

TIME PIECE PROVIDED WITH A DATE DIAL

The present invention relates to a timepiece provided with a date display comprising a date disk having 31 teeth engaging with a positioning jumper and with a wheel assembly in kinematic connection with a motion-work wheel assembly of the timepiece to drive this disk one step every twenty-four hours.

There have been many proposals for avoiding the difficulties of conventional date displays for timepieces, in which the size of the digits is limited to 1/31 of the circumference of the date disk, because in a wristwatch this often becomes too small to be easily read with the naked eye.

It is for this reason already prior art to display the units digits separately from the tens digits, with the object of no longer being dependent on dividing the date disk up into 31 dates. This problem is made still more acute when the date window is on the 6 o'clock-12 o'clock axis of the dial, forcing the watchmaker to place the digits of two-digit numbers side by side, this further reducing their size to 1/53 of the circumference.

Of the many solutions that have appeared in the prior art, EP 1 426 836, EP 1 070 996, EP 1 369 753 and EP 0 529 191 may be mentioned. All these mechanisms have two moving disks, one carrying the units digits and the other the tens digits, which makes for relatively complicated mechanisms.

It is an object of the present invention to enable the units and tens of dates to be displayed separately by a simplified mechanism.

To this end, this invention relates to a timepiece provided with a date display comprising a date disk having 31 teeth engaging with a positioning jumper and with a wheel assembly in kinematic connection with a motion-work wheel assembly of the timepiece to drive this disk one step every twenty-four hours, as claimed in claim 1.

The accompanying drawing shows, schematically and by way of example, an embodiment of the timepiece provided with a date display forming the subject of the present invention.

Figure 1:
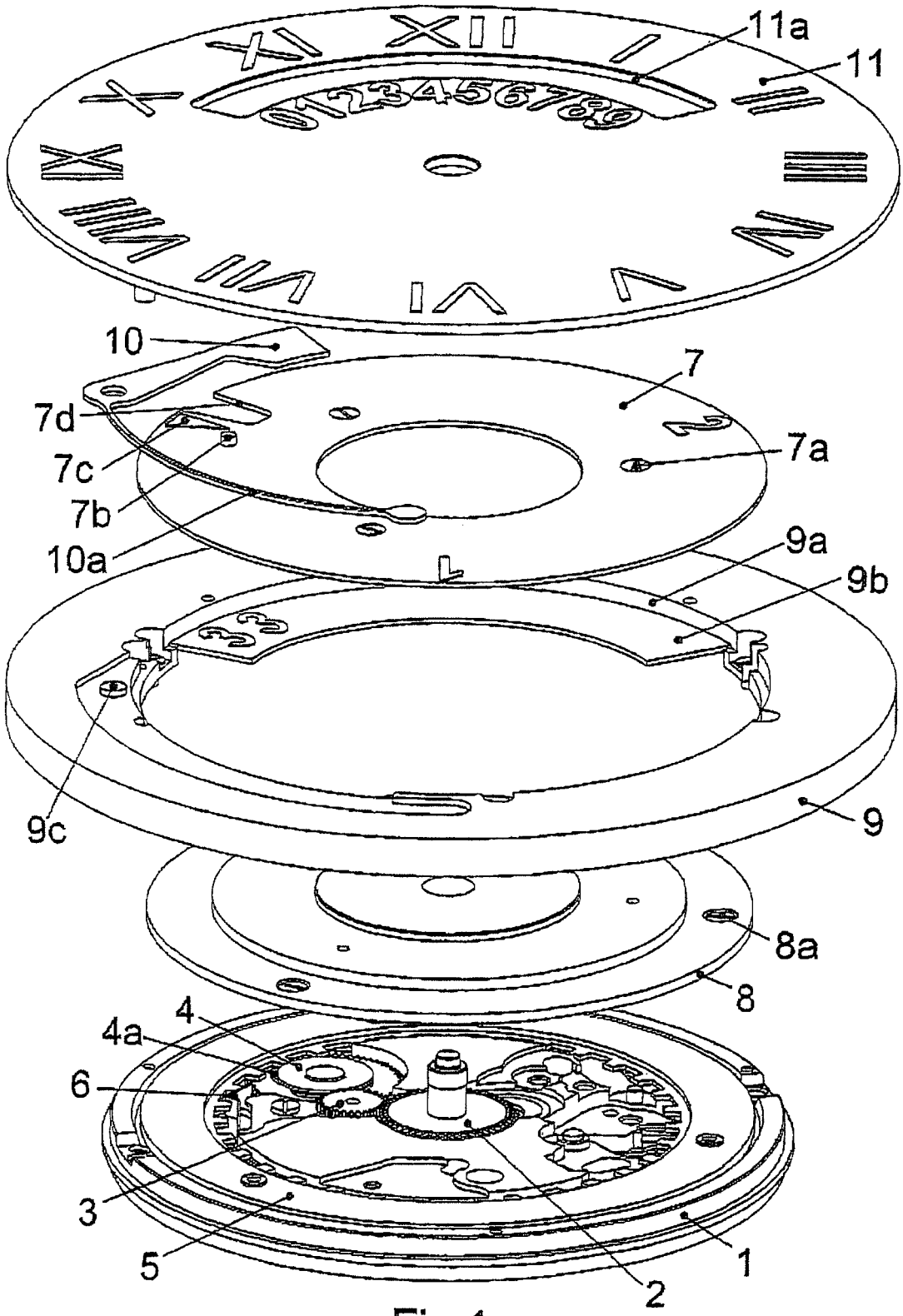
FIG. 1 is an exploded perspective view of the date display device of the timepiece.

FIG. 1 shows the motion work of a timepiece 1 which comprises an hour wheel 2 meshing with an intermediate wheel 3 which in turn meshes with a date wheel 4. The latter has a tooth 4*a* for driving a date disk 5 that has 31 teeth. The gear ratio is chosen so that the date wheel 4 makes one revolution in 24 hours so that its tooth 4*a* drives the date disk one step every 24 hours. A jumper 6 positions the date disk 5 between actuations of the tooth 4*a*.

A tens disk 7 is fixed to the date disk 5 by a spacer 8. This spacer 8 is fixed by screws 8*a* to the date disk 5 and the tens disk 7 is fixed to the spacer 8 by screws 7*a*. The tens disk 7 carries the digits 1 and 2 for the tens and twenties. The angular space separating these digits of the tens and twenties from each other corresponds to ten angular steps of the date disk 5. A pointer 7*c*, visible in FIGS. 2 to 5, is also placed on the tens disk 7 at an angular distance of ten steps of the date disk 5 from the digit 1 of the tens. This pointer 7*c* is adjacent to a window 7*d* situated between the pointer 7*c* and the digit 2 of the twenties.

An annular intermediate support 9 is fixed to the timepiece 1. It contains a central opening 9*a* to accommodate the tens disk and carries a plate 9*b* in the shape of the arc of a circle, on the left-hand end of which are inscribed two digits 3 for the thirties. This annular intermediate support 9 also carries a pivot 9*c* for the pivoting of a movable mask 10 fitted with a return spring 10*a* which normally keeps this mask 10 in the position illustrated in FIG. 3. A pin 7*b* attached to the tens disk 7 serves to move the mask 10 to the position shown in FIG. 2 for the purpose described later.

The timepiece's dial 11, which is fixed to the annular intermediate support 9, comprises an arcuate window 11*a*, the center of the circle of which is the center of the dial, through which can be seen an annular sector of the tens disk and, through its window 7*d*, the arcuate plate 9*b* carrying the two digits 3 for the thirties. Along the inner edge of this arcuate opening 11*a* are inscribed the units digits from 0 to 9, with a spacing corresponding to 1/31 of the circumference on which they are distributed.

Figure 2:
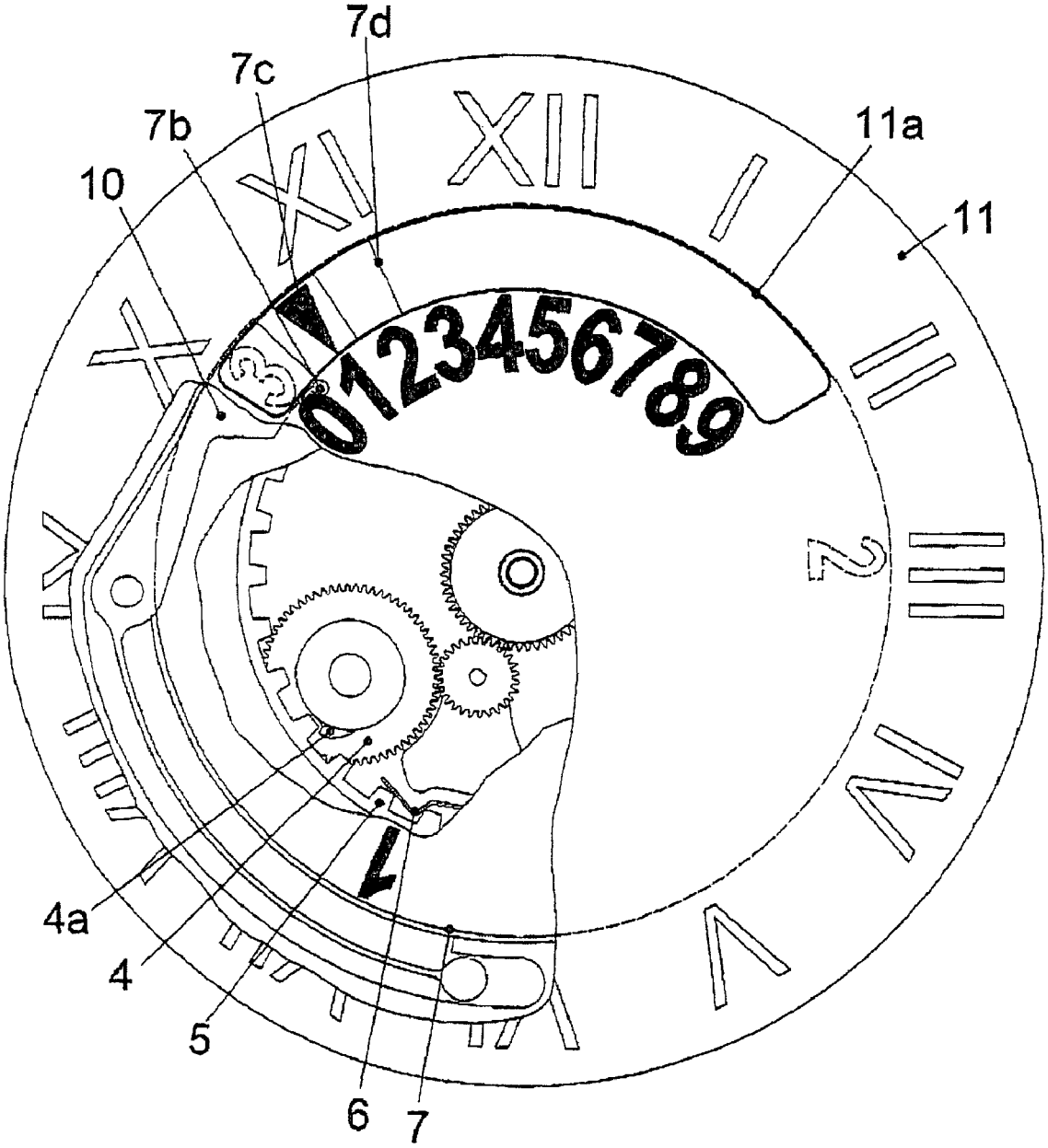
FIG. 2 is a front plan view of the timepiece with partial cutaway.
Figure 3:
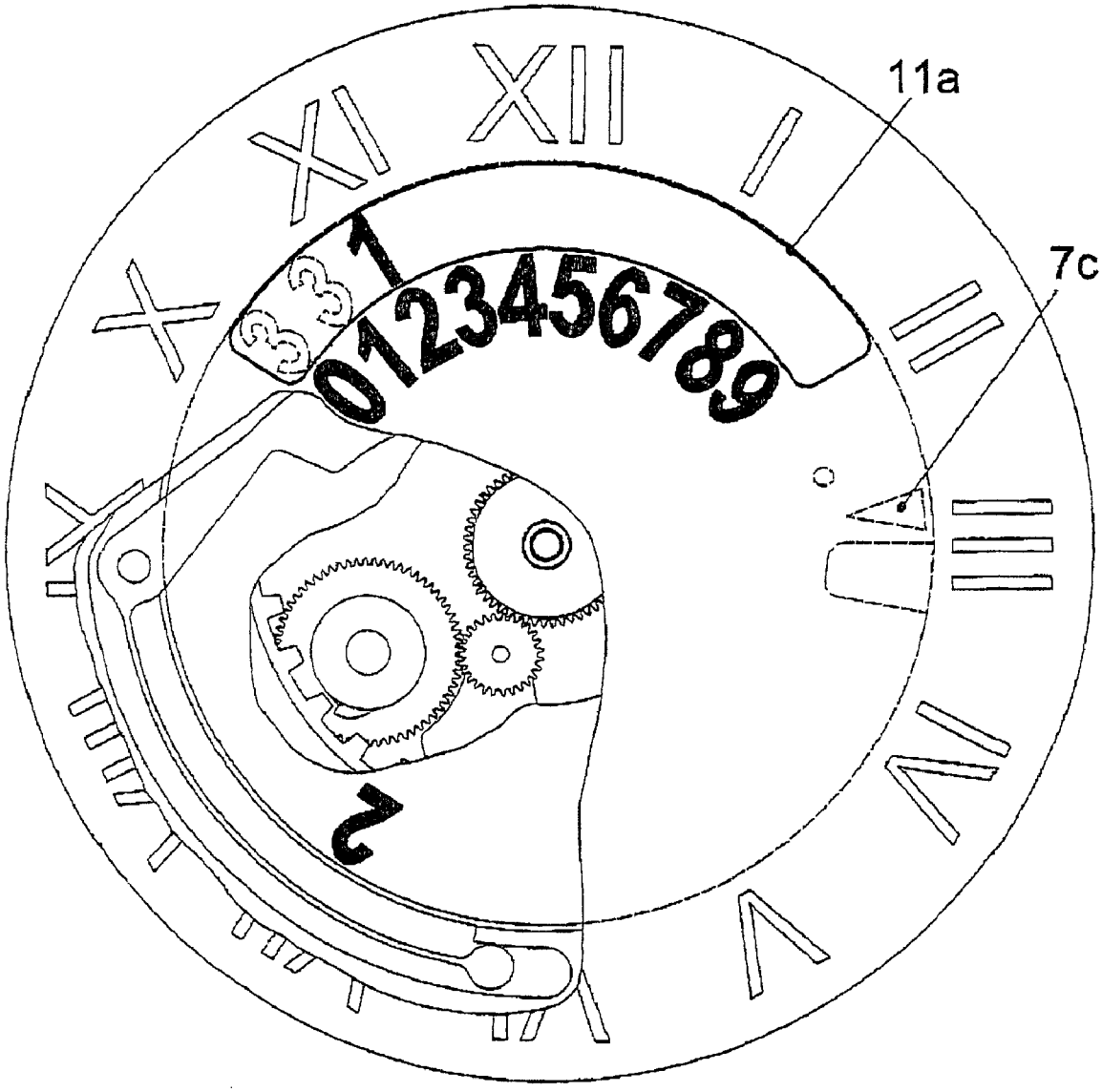
FIG. 3 is a view similar to FIG. 2 with the display device in another position.

FIG. 2 shows the display device when indicating the 1st of the month. The pointer 7*c* is pointing at the units digit 1. It then moves one step to point to the 2 digit, and so on as far as the 9 digit which is at the right-hand end of the window 11*a*. At the change from the 9th to the 10th of the month, the pointer 7*c* passes out of the window 11*a*, and simultaneously the 1 of the tens appears over the 0 of the units. This digit 1 then moves one step every twenty-four hours, each time pointing at another digit of the units. FIG. 3 shows it over the digit 2 of the units, thus indicating that the date is the 12th. The same then happens with the 2 digit for the twenties.

Figure 4:
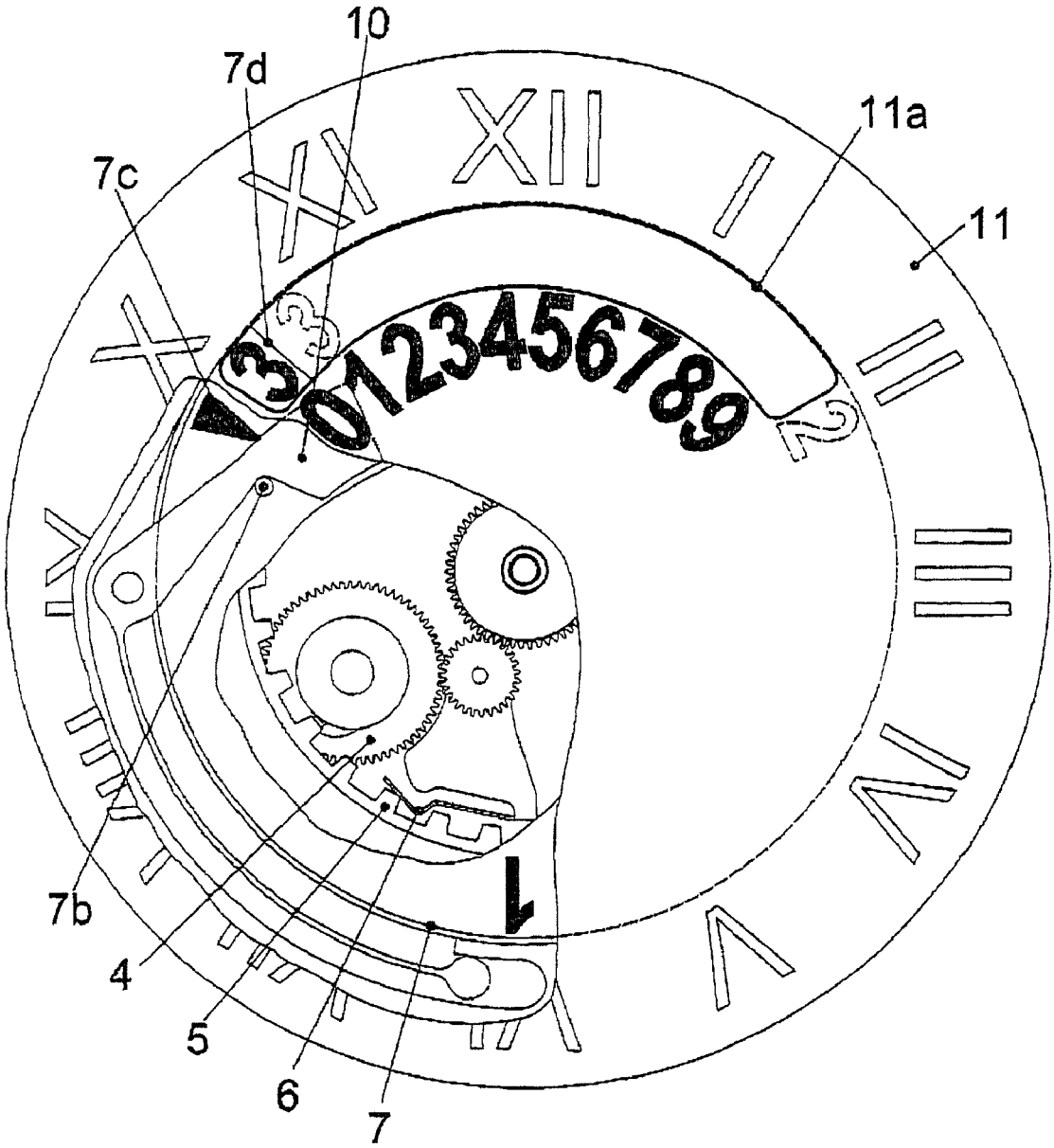
FIG. 4 is a view similar to FIG. 2 with the display device in another position.
Figure 5:
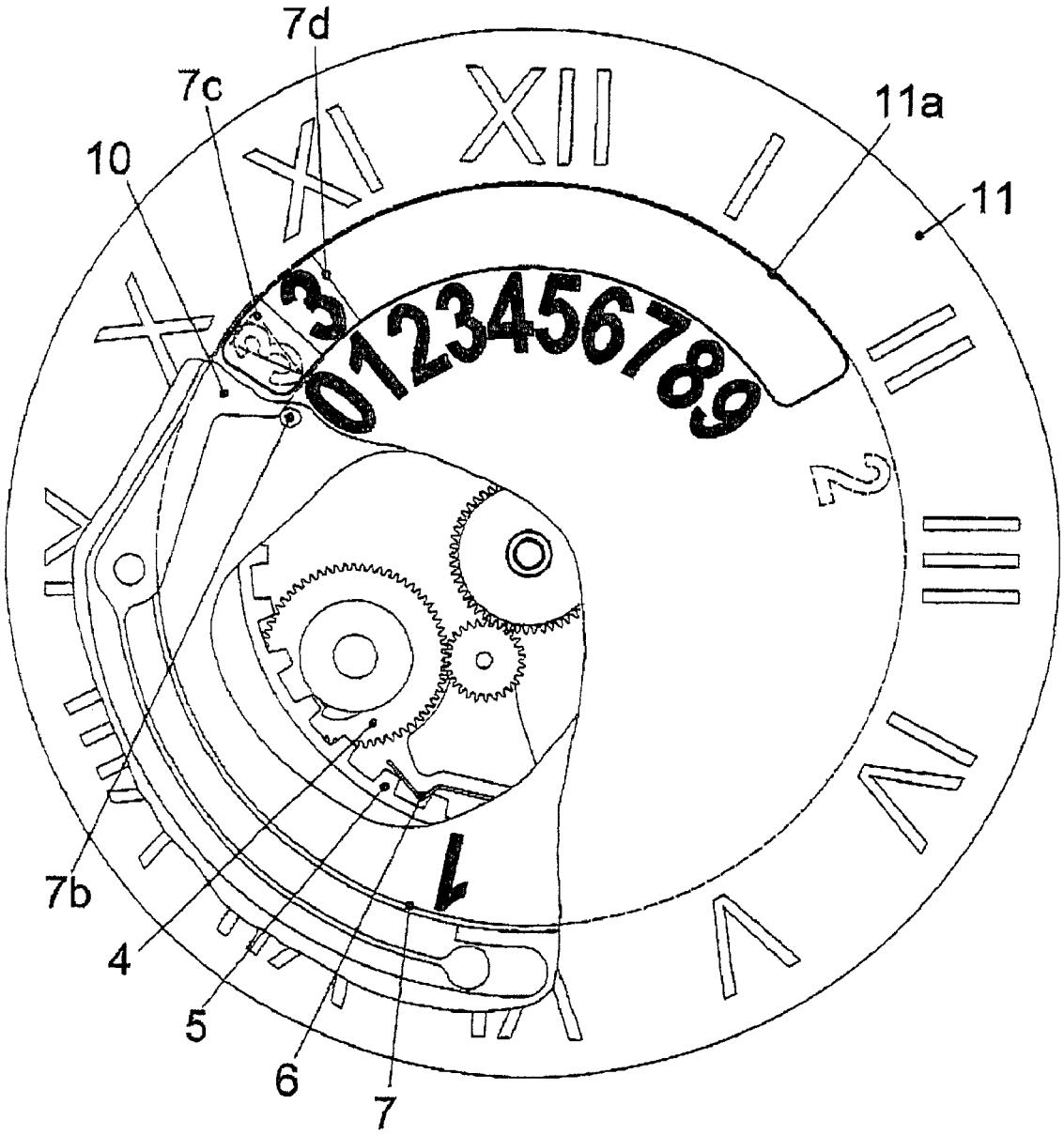
FIG. 5 is a view similar to FIG. 2 with the display device in another position.

FIGS. 4 and 5 respectively show how the 30th and 31st are indicated. When the 2 for the twenties passes out of the window (FIG. 4), the window 7*d* of the tens disk 7 appears at the other end of the arcuate window 11*a*, uncovering the first 3 digit for the thirties carried by the plate 9*b* fixed to the annular support 9, and appears over the 0 digit of the units. During the subsequent movement of the tens disk 7 (FIG. 5), the window 7*d* moves over the second of the digits 3 for the thirties on the annular plate 9*b* over the 1 of the units. Simultaneously the pointer 7*c* is brought over the 0 of the units. However, during this movement the pin 7*b* of the tens disk raises the mask 10 which then comes between the pointer 7*c* and the arcuate window 11*a*, so that this pointer 7*c* cannot be seen.

The invention claimed is:

1. A timepiece provided with a date display comprising a date disk having 31 teeth engaging with a positioning jumper and with a wheel assembly in kinematic connection with a motion-work wheel assembly of the timepiece to drive this disk one step every twenty-four hours, said timepiece being characterized in that the dial of the timepiece carries the digits of the units of dates distributed around a circular sector with spacing corresponding to one step of the date disk and is interrupted by an arcuate window extending all the way around the angular length of said circular sector and through which there appears a pointer member joined to the date disk and carrying, in the direction of rotation of the latter, a units pointer, the digits 1 and 2 for the tens and twenties and a window for showing twice in succession a digit 3 for the thirties, a movable mask (10) with a return spring being provided between the timepiece dial and the pointer member which is provided with an element for driving the movable mask against the action of its return spring in order to position it in front of said pointer when the latter is over the 0 digit of the units.

2. The timepiece as claimed in claim 1, in which the digits 3 for the thirties are carried by an element located between the date disk and the pointer member carrying the pointer of the units and the digits 1 and 2 of the tens and twenties.

3. The timepiece as claimed in claim 2, in which the element carrying the digits 3 for the thirties is joined to a support fitted to the timepiece to which the dial is fixed.

* * * * *